US006604994B2

(12) United States Patent
Achen

(10) Patent No.: US 6,604,994 B2
(45) Date of Patent: Aug. 12, 2003

(54) SIMPLIFIED COMBUSTION AIR SECURITY VENT

(76) Inventor: John J. Achen, 12432 Del Rico, Yuma, AZ (US) 85367

( * ) Notice: Subject to any disclaimer, the term of this patent is extended or adjusted under 35 U.S.C. 154(b) by 0 days.

(21) Appl. No.: 10/025,060

(22) Filed: Dec. 19, 2001

(65) Prior Publication Data

US 2002/0098793 A1 Jul. 25, 2002

Related U.S. Application Data

(63) Continuation-in-part of application No. 09/746,382, filed on Dec. 21, 2000.

(51) Int. Cl.[7] ..... F24F 7/00
(52) U.S. Cl. ..... 454/271
(58) Field of Search ..... 454/270, 271, 454/276, 277; 52/198, 199, 302.1

(56) References Cited

U.S. PATENT DOCUMENTS 4,469,018 A * 9/1984 Taulman ..... 454/276
4,550,648 A * 11/1985 Eagle ..... 454/260
4,699,045 A * 10/1987 Hensley ..... 454/313
5,394,663 A * 3/1995 Jackson ..... 52/199
5,590,477 A * 1/1997 Carfagno, Sr. ..... 34/235
6,012,260 A * 1/2000 Hendrick et al. ..... 52/302.1

* cited by examiner

*Primary Examiner*—Derek Boles
(74) *Attorney, Agent, or Firm*—Cahill, von Hellens & Glazer P.L.C.

(57) ABSTRACT

A vent assembly for mounting in a passageway extending through an exterior wall to provide ventilation to the space bounded by the exterior wall includes an apertured panel exteriorly juxtaposed with a security grate to prevent unauthorized intrusion through the exterior wall. Carriage bolts extend through the apertured panel and security grate into engagement with an anchoring element, such as a pair of L-shaped brackets disposed on opposed sides in the passageway. The smooth surfaced head of the carriage bolts, coupled with the square cross-section of the shank adjacent the head mating with square apertures in the apertured panel and in the security grate prevent turning of the carriage bolts from a location external to the exterior wall. Air through the passageway may be filtered with an air filter supported by bolts extending from the security grate. In a variant vent assembly for use in new construction, a louvered panel of cold rolled steel includes sections folded toward the exterior wall and supporting tabs for attachment to a sidewall of the passageway and/or further sections for attachment to the surface of the exterior wall adjacent the opening of the passageway.

15 Claims, 8 Drawing Sheets

SIMPLIFIED COMBUSTION AIR SECURITY VENT

CROSS-REFERENCE TO RELATED APPLICATIONS

The present application is a continuation-in-part application of an application entitled "Combustion Air Security Vent", filed Dec. 21, 2000, and assigned Ser. No. 09/746,382 describing an invention by the present inventor. The present invention is related to the inventions described by the present inventor in U.S. Pat. No. 5,758,457 entitled "Vent With Security Gate" issued on Jun. 2, 1998, and U.S. Pat. No. 5,976,009 entitled "Vent With Multi-Apertured Security Gate" issued on Nov. 2, 1999.

BACKGROUND OF THE INVENTION

1. Field of the Invention

The present invention relates to vent assemblies and, more particularly, to a vent assembly for an enclosed area and having a security grate for preventing access through a juxtaposed passageway.

2. Description of Related Art

During the summer time in the southwest United States, the temperature in an unvented enclosed garage increases to well over 100 degrees. Such a high temperature may cause damage or deterioration to temperature sensitive items stored or otherwise disposed within such garage. Moreover, the high temperature renders it very uncomfortable for persons working within the garage. To alleviate this problem, it is common to cut one or more apertures in a garage door and cover such aperture with a multi-louvered screened vent readily available in hardware stores. Such vents permit convective airflow through the garage door and generally restrain intrusion of larger sized insects.

Because the commercially available vents are usually of aluminum or light sheet metal, they are easily destroyed to permit access to the juxtaposed aperture. The now accessible aperture permits a child or small adult to pass therethrough and permits use of extended tools and the like to unlock and open the garage door. The resulting accessibility to the garage and its contents is an invasion of privacy and promotes burglary. The garage owner, and particularly a homeowner having such a vented garage door, is therefore faced with the quandary of either accepting an unreasonably hot garage or risk intrusion.

To encourage airflow into and out of a garage through a closed garage door, one or more of the conventional types of vents are often located close to the bottom and to the top of the garage door. Such positioning permits escape of hot air through the upper vents due to convection and a compensatory inflow of cooler air through the bottom vents. Such plurality of apertures promotes air circulation with attendant cooling benefits but also provide a plurality of locations for intrusion into the confines of the garage.

Many residential garages have gas fired water heaters located therein. These heaters require make up air to provide a continuing source of oxygen to maintain combustion. Often, vents attached with screws accessible from the outside of an exterior wall, door or garage door are used to establish the requisite airflow. Because of the manner of attachment of these vents, they are easily removed by an intruder and access to the interior of the garage becomes possible.

Many municipalities are redrafting or adopting a building code requiring vents in an exterior wall of a garage within twelve (12") inches of the ceiling and of the floor to insure an adequate source of make up air. Alternatively, such vents may be located in the garage door itself.

SUMMARY OF THE INVENTION

To prevent physical intrusion of a human body through a venting aperture or passageway in an exterior wall of a garage, a security grate is positioned adjacent the aperture and inwardly of a conventional louvered vent. Fastening means, such as carriage bolts, extending through square or slotted holes in the louvered vent and security grate and retained by nuts to L-brackets, secure the security grate in place while preventing unthreading of the bolts. Alternatively or in combination other, fastening means may be threadedly engaged with wall studs of the exterior wall defining the passageway of the vent. Preferably, the security grate is a sheet of iron or steel of sufficient thickness to prevent destruction by conventional tools. The apertures in the security grate are limited in size to preclude passthrough of tools for creating access to the garage. That is, the size of the apertures minimize the likelihood of intrusion of a tool to unlock the garage door by manipulation of the tool through the security grate. A filter may be disposed at the interior end of the passageway to prevent in flow of dust and other debris.

It is therefore a primary object of the present invention to provide a simplified vent assembly for introducing combustion air through an exterior wall while preventing intrusion therethrough.

Another object of the present invention is to provide a simplified vent assembly for preventing intrusion through a venting passageway of an exterior wall.

Still another object of the present invention is to provide a security grate attendant an aperture in an exterior wall to accommodate venting of the space interior of the exterior wall while preventing intrusion into the space.

A further object of the present invention is to provide a vent assembly for an exterior wall to prevent intrusion and which vent assembly is not dismantleable from the exterior.

A yet further object of the present invention is to provide a lowered wall vent assembly with a bracket located within a passageway in a wall to secure a security grate of the vent assembly.

A still further object of the present invention is to provide a method for preventing intrusion through an aperture in an exterior wall while accommodating venting.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
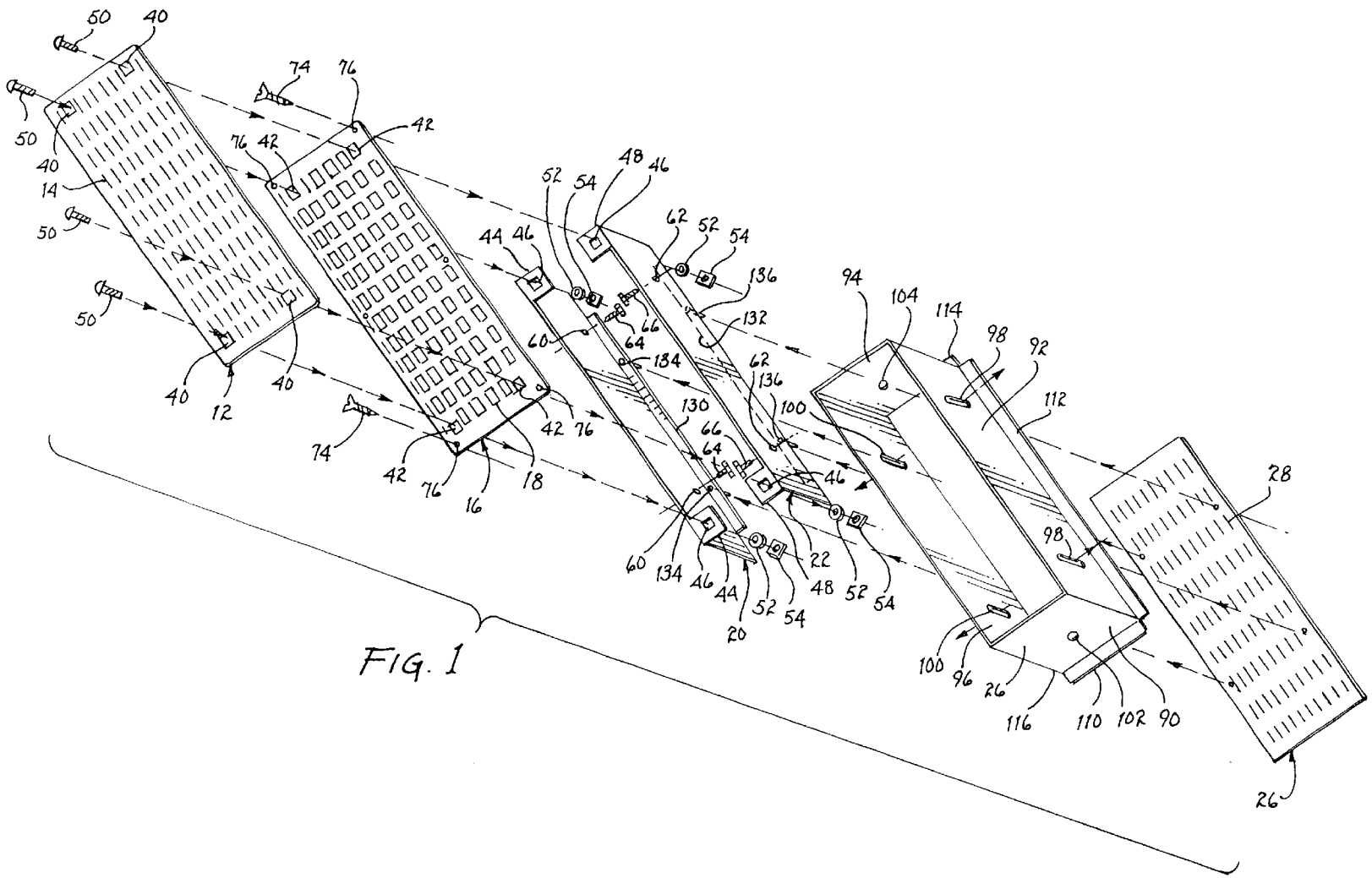
FIG. 1 is an exploded view of the elements of a vent assembly mountable in an exterior wall.

Referring to FIG. 1, there is illustrated in an exploded view of certain components of a vent assembly 10 mountable within a passageway in an exterior wall of a building to permit airflow through the exterior wall. For example, such exterior wall may be a wall circumscribing in part a garage wherein a gas fired heater or the like is located. The vent assembly includes an apertured panel 12 having downwardly directed louvers 14 for permitting airflow therethrough but restraining inflow of rainwater. A security grate 16 is located adjacent apertured panel 12 and includes a plurality of slots or apertures 18 for accommodating airflow through the security grate but which are of sufficiently small size to preclude insertion of a tool usable to initiate raising of a garage door or the like. A pair of brackets 20, 22 are mountable within the passageway extending through the exterior wall. These brackets are secured to the passageway and serve as anchors for attaching apertured panel 12 and security grate 16. A four sided shroud 24 may be mounted within the passageway to define its boundary. It may also serve as an anchor for attaching a panel at the interior wall, such as panel 26.

Referring jointly to FIGS. 1, 2, 3 and 4, further details of vent assembly 10 will be described. Apertured panel 12 includes a square hole 40 mounted close to each corner of the apertured panel. Similarly, security grate 16 includes a square hole 42 mounted close to each corner and coincident with respective ones of square holes 40 in the apertured panel. Bracket 20 includes a pair of upturned tabs 44 containing square holes 46. Similarly, bracket 22 includes downturned tabs 48 having square holes 46 disposed therein. Carriage bolts 50 includes a square cross-section shank adjacent the head, as is common, and the remaining part of the shank is threaded. Each of the carriage bolts extends through corresponding square apertures 40, 42 and 46 with the square cross-sectional shank portion penetrably engaging such apertures. Thereby, the resulting interference between the square cross-sectional shank and the holes precludes rotation of the carriage bolts. A washer 52 and nut 54 penetrably engage each of the carriage bolts to secure apertured panel 12 and security grate 16 with the corresponding tabs of brackets 20 and 22. Each of brackets 20, 22 include one or more apertures 60, 62, respectively, for penetrably receiving lag bolts 64, 66, respectively; alternatively, screws may be used. Thereby, lag bolts 64, 66 secure the brackets to stud 70 or other structural members of wall 72 to provide a foundation for retaining security grate 16 in place. As is evident from FIG. 2, any attempt to remove carriage bolts 50 by rotating the head of one or more of the carriage bolts will be fruitless. The only way in which the carriage bolts can be loosened is that of rotating each nut 54 relative to its respective carriage bolt. A flat security grate is used primarily with a flat wood sided exterior wall while a security grate having a peripheral lip, as discussed below, is used primarily with a stucco exterior wall.

To further stabilize the attachment of security grate 16 to the passageway in the exterior wall, screws 74 may be used. Preferably, screw 74 is a countersunk screw penetrably engaging a countersunk hole 76 in each of the corners of security grate 16. Each of screws 74 threadedly engages structural members of wall 72, which structural members may be studs 70 or the like. As particularly shown in FIG. 2, wall 72 may include one or more exterior panels 77, 78 adjacent structural members 70, which may be vertical studs or horizontal cross-members. Apertured panel 12 includes a peripheral flange 80 bent approximately 45 degrees toward wall 72. This flange shields the perimeter of security grate 16. Furthermore, the flange discourages outward bending of the apertured panel to permit access to screws 74. Thus, screws 74 are shielded by apertured panel 12 and discourage dismantling of the security grate from the supporting wall.

It is to be understood that for installations wherein impossibility of unauthorized removal of security grate 16 is not of paramount importance, brackets 20, 22 may be eliminated. In such installation, screws 74 serve as the primary anchoring mechanisms for retaining the security grate in place. The attachment of the apertured panel to the security grate may be with the carriage bolts shown, or with other nut and bolt assemblies, rivets, etc. Furthermore, the shielding provided by apertured panel 12 serves as a deterrent against unauthorized removal of the security grate.

Figure 2:
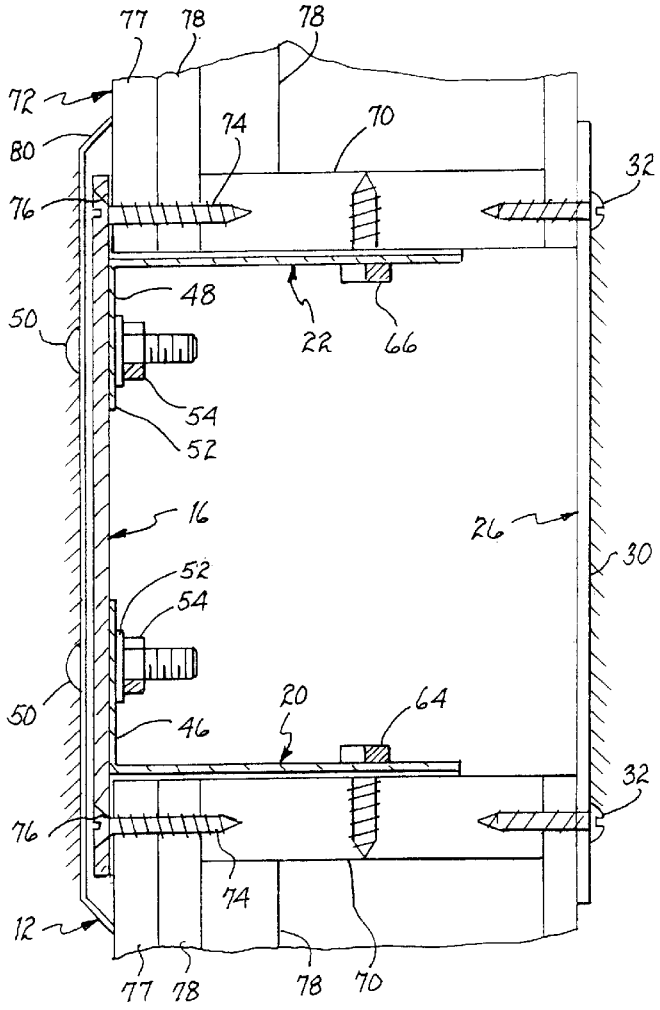
FIG. 2 is a cross-sectional view of the vent assembly.

As shown in FIGS. 1 and 2, a panel 26 includes a plurality of slots 28 (as shown in FIG. 1), which may include louvers 30, as shown in FIG. 2, to permit airflow through vent assembly 10. Panel 26 may be attached to the interior surface of exterior wall 72 by screws 32, or the like, engaging elements of the exterior wall, such as studs 70. The main purpose for panel 26 is to prevent placement of objects within vent assembly 10 or in the passageway that may impede airflow therethrough. Furthermore, the panel provides an aesthetic benefit.

Figure 4:
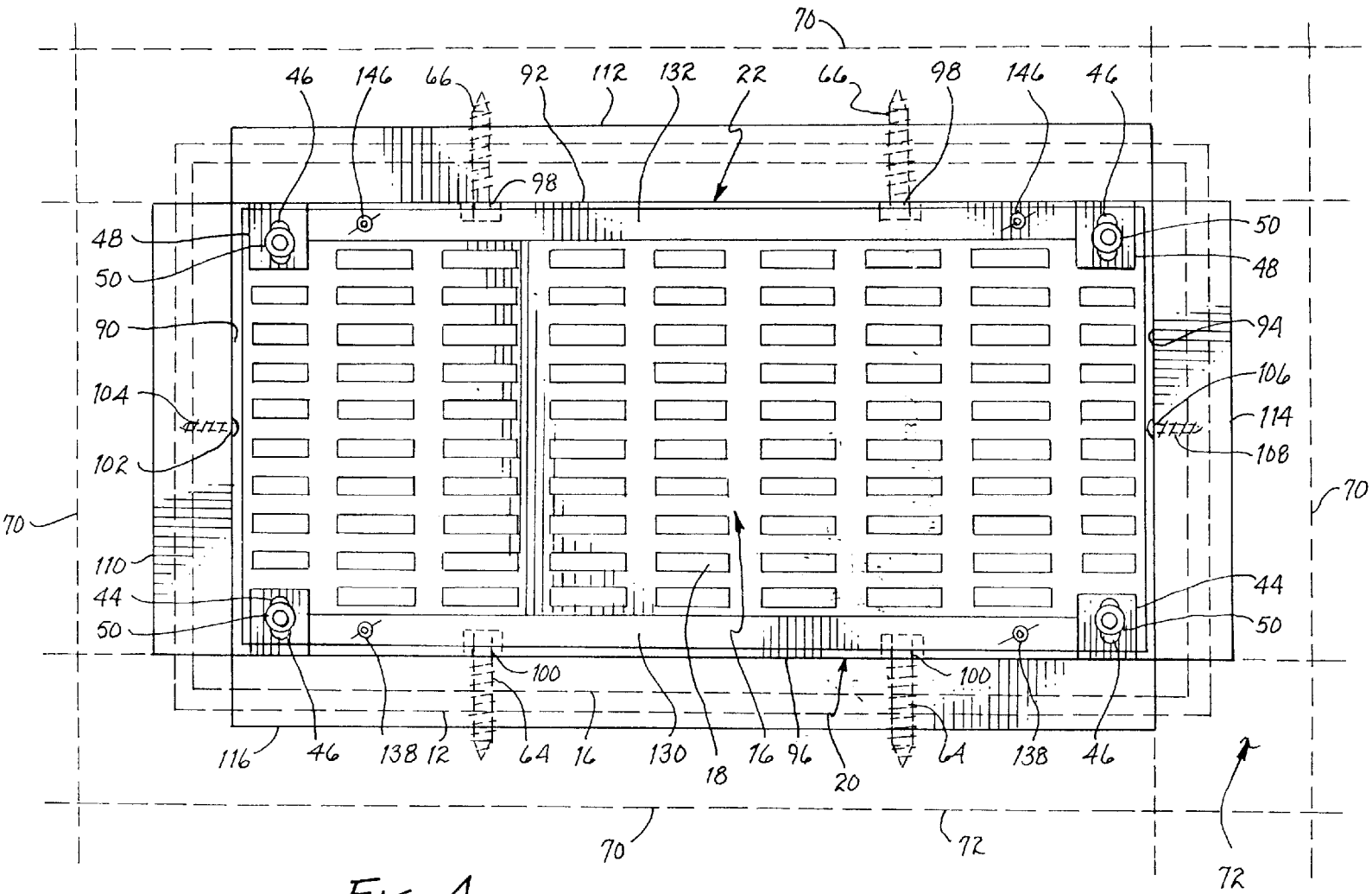
FIG. 4 is a rear view of the vent assembly shown in FIG. 1.

Referring jointly to FIGS. 1 and 4, there is illustrated a shroud 24. The shroud may be a single unit having four walls or it may be configured as four panels 90, 92, 94, 96 forming the essentially rectangular shroud. Panel 92 includes slots 98 for accommodating penetrable insertion of lag bolts 66. Similar slots 100 are formed in panel 96 to accommodate lag bolts 64. Panel 90 may include an aperture 102 for receiving a lag bolt 104 or the like to retain the panel against a corresponding surface within the passageway in exterior wall 72. Panel 94 includes a similar aperture 106 for securing the panel with a lag bolt 108 to a corresponding surface within the passageway in exterior wall 72. Each of panels 90, 92, 94, 96 may include a 90 degree (90°) flange, 110, 112, 114, 116, respectively, to bear against the interior wall surface of exterior wall 72 to limit the degree of insertion of the respective panel and to permit attachment by driving a nail or inserting a screw (not shown) therethrough into the underlying surface of the exterior wall. Moreover, such screw may be used to also attach panel 26. A main function of shroud 26 is that of defining the passageway through the exterior wall in the event such passageway is not already defined by structural members. Thereby, access to sections of the exterior wall lateral of the passageway is precluded.

Figure 3:
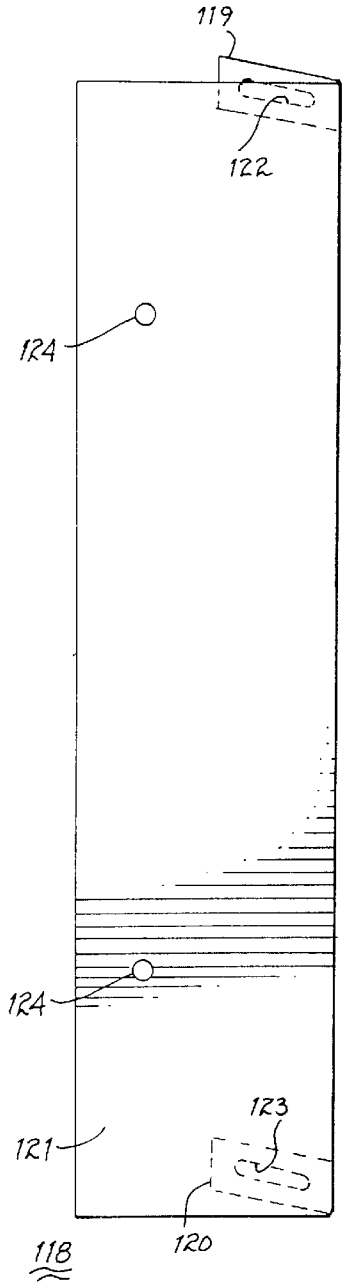
FIG. 3 is an isometric view of a variant bracket of the vent assembly shown in FIG. 1.

Referring to FIG. 3, there is illustrated a variant bracket 118. This variant bracket may be substituted for either or both of brackets 20, 22 described above. In variant bracket 118, elongated tabs 119, 120 extend from the front edge of a plate 121. Each of tabs 119, 120 includes an elongated slot 122, 123, respectively. The width of each of slots 122, 123 is commensurate with the dimension of opposed walls of the square shank section of carriage bolts 50 whereby a carriage bolt inserted within one of these slots is precluded from turning. Plate 121 includes apertures 124 for securing variant bracket 118 to a corresponding surface defining the passageway through exterior wall 72. The purpose of elongated slots 122, 123 is that of accommodating different vertical positions of holes 40 in panel 12 and holes 42 in security grate 16.

Figure 6:
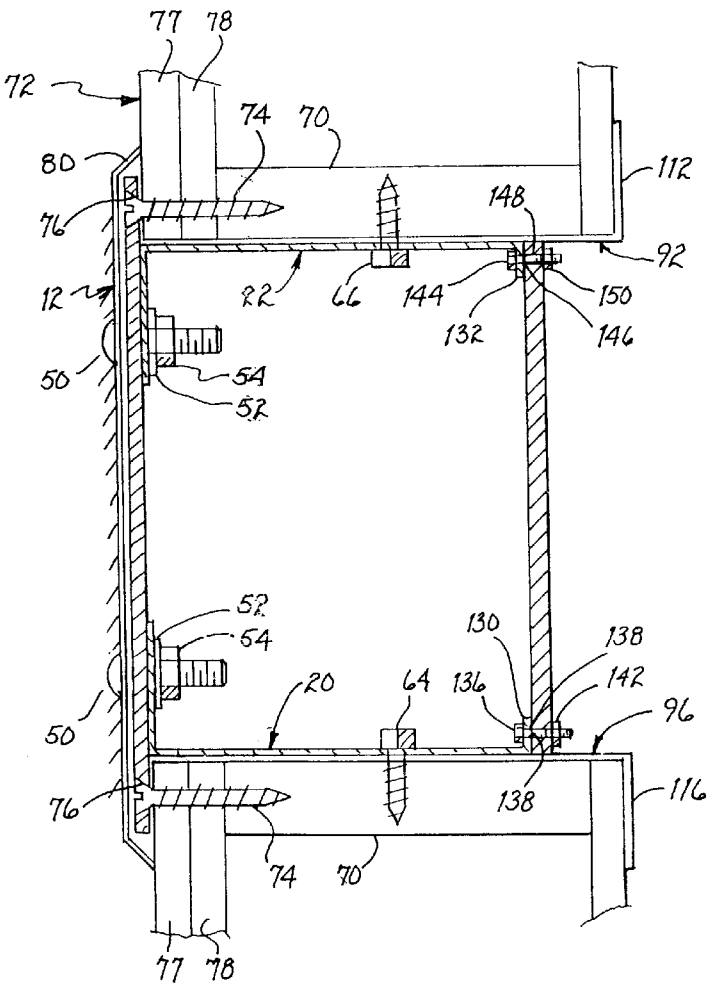
FIG. 6 is a cross-sectional view illustrating a variant of the vent assembly.

As shown in FIGS. 4 and 6, brackets 20, 22 may include rear lips 130, 132. These lips include apertures 134. The purpose of lips 130, 132 is to provide a mounting for a panel 134. In particular, this panel is secured to lip 130 by bolt 136 extending through an aperture 138 in the lip and through a passageway 140 extending through the panel and into threaded engagement nut 142. Similarly, panel 134 is secured to lip 132 by bolt 144 extending through aperture 146 in the lip and through passageway 148 in the panel and into threaded engagement nut 150. Alternatively, sheet metal screws not requiring a nut could be used to simplify the installation. Panel 134 may be apertured to permit airflow through vent assembly 10. Alternatively, it may be transparent or translucent to permit passage of light through the vent assembly during periods when ventilation or combustion air is not needed within the garage or other space bounded by exterior wall 72. Or, the panel may be of insulative material to reduce heat transfer through the vent assembly. It is to be noted that FIG. 6 also illustrates in cross-section panel 92 and its flange 112 and panel 96 and its flange 116.

Figure 5:
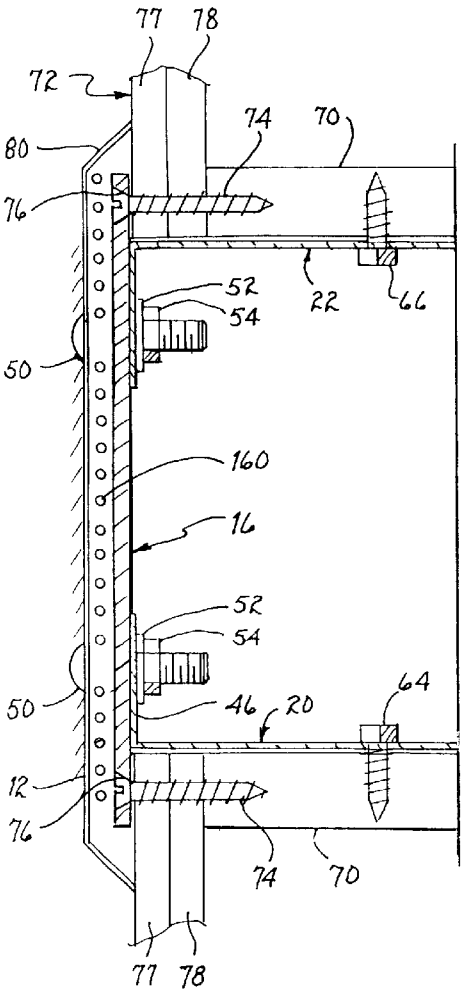
FIG. 5 is a partial cross-sectional view of the vent assembly illustrating a screen.

FIG. 5 illustrates a variant of vent assembly 10 shown in FIG. 2. That is, a screen 160 is disposed intermediate apertured panel 12 and security grate 16 to preclude insects and the like from entering the vent assembly. Angled flange 80 may be extended laterally from the configuration illustrated in FIG. 2 in order to accommodate the thickness of screen 160 and still have the flange bear against the exterior surface of exterior wall 72 to shield the edge of security grate 16. It is to be understood that the screen may also be placed intermediate the security grate and the exterior wall.

Figure 7:
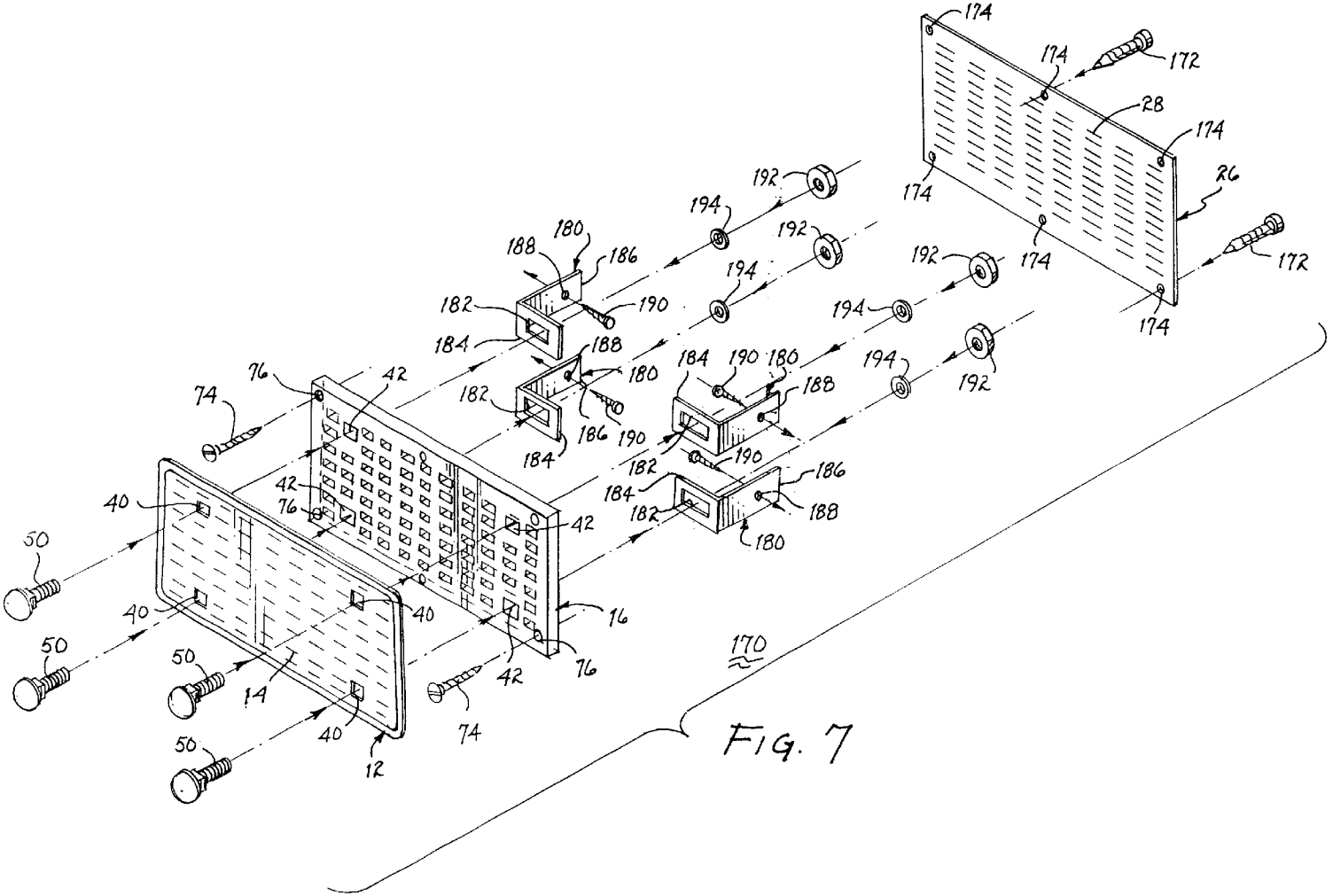
FIG. 7 is an exploded view of the elements of a simplified vent assembly mountable in an exterior wall.

Referring to FIG. 7, there is illustrated an exploded view of a simplified security vent assembly 170. This assembly includes certain components common with the security vent assembly described above and for such common components, common reference numerals will be used. An apertured panel 12 includes a plurality of downwardly facing louvers 14 to permit airflow therethrough and yet discourage passthrough of rainwater and the like. A plurality of square hole 40 are disposed therein for penetrable engagement with threaded carriage bolts 50 having a rectangular shank section adjacent the head. A security grate 16 includes a plurality of square holes 42 coincident with holes 40 in panel 12 for penetrable engagement by carriage bolts 50. The corners of the security grate may include holes 76 for penetrable engagement with screws 74 to be threadedly engaged with an underlying element, such as a stud, of the exterior wall to which assembly 170 will be attached. A further panel 26 may be incorporated and positioned at the inside opening of the passageway extending through an exterior wall to hide the passageway and to prevent access to the passageway. The panel may be secured to the structure surrounding the passageway by sheet metal or wood screws 172 penetrably engaging holes 174 in panel 26. Each of a plurality of L-shaped brackets 180 includes a rectangular aperture 182 disposed in leg 184 of the bracket. The short dimension of aperture 182 is commensurate with the corresponding dimension of holes 40, 42 and the square shank section of carriage bolt 50. Thereby, each of the carriage bolts penetrates panel 12, security grate 16 and leg 184 of bracket 180, each of which contributes to the inability of the carriage bolt to rotate about its longitudinal axis. Leg 186 of each of brackets 180 includes one or more holes 188 for penetrable engagement with a corresponding nail or screw 190. Screw 190 is inserted through hole 188 and brought into threaded engagement with either a sidewall, a bottom wall or a top wall of the passageway extending through the exterior wall; necessarily, brackets 180 would have to be rotated 90 degrees to permit engagement of the corresponding bottom or top walls of the passageway by corresponding screws 190. Each of carriage bolts 50 is retained in place by a corresponding one of nut 192 and lock washer 194; self-locking nuts may also be used.

Figure 8:
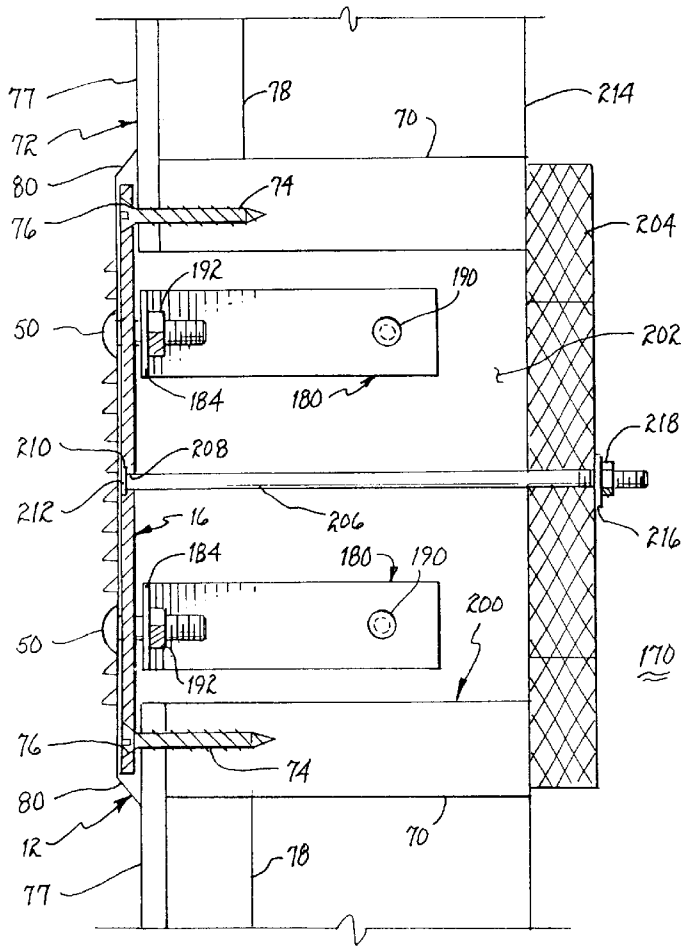
FIG. 8 is a cross-sectional view of the vent assembly showing a filter in place of an apertured interior covering plate.

Referring to FIG. 8, security vent assembly 170 mounted in conjunction with a passageway 200 formed within exterior wall 72. This figure illustrates a side view looking horizontally into a passageway 200 formed within exterior wall 72. The passageway may be formed by a pair of studs 70 disposed horizontally and end walls, of which wall 202 is shown. Security vent 170 shown in FIG. 8 differs from that shown in FIG. 7 in that a filter 204 is mounted at the interior end of passageway 200. Alternatively, the filter may be mounted within the passageway and supported in place by a much shorter bolt. Security grate 16 may be attached to studs 70 by wood screws, or the like, 74 extending through countersunk holes 76 in the security grate. Apertured panel 12 extends across the front of the security grate and may include downturn flanges 80. As illustrated, panel 12 covers the heads of screws 74 to render removal of these screws difficult. L-brackets 180 are secured to wall 202 by screws 190. For purposes of rigidity, a pair of screws 190 may be mounted in each L-bracket 180. Panel 12 and security grate 16 are secured to leg 184 of each L-bracket 180 by lag bolts 50 penetrably engaging panel 12, security grate 16 and corresponding rectangular apertures 182 in the respective L-brackets. Nuts 192 draw these components tightly against one another. It will be noted that disassembly of security vent assembly 170 is precluded by the use of carriage bolts 50 as they can not be turned to unthread them from nut 192. While it may be possible to bend the edges of panel 12 to obtain access to the heads of screws 74, disengaging them from their respective studs, will not result in detachment of the security grate from the external wall as such attachment if maintained by engagement with L-brackets 180.

Under certain circumstances, it may be preferable to have an air filter in place of panel 26 (see FIG. 7). Such air filter may be incorporated by use of an elongated bolt 206 penetrably engaged with a hole 206 in security grate 16. This hole may include an annular recess 210 to receive head 212 of bolt 206. The bolt is long enough to extend past interior side 214 of exterior wall 72 and for a further distance greater than the thickness of a filter 204 to permit penetrable engagement of the filter with the bolt. Filter 204 is retained upon the bolt by a washer 216 and a wingnut 218. While only one bolt has been shown, it is to be understood that a pair of bolts or yet further bolts may be used for the purpose of securing either air filter 204 or panel 26 in place adjacent side 214.

Figure 9:
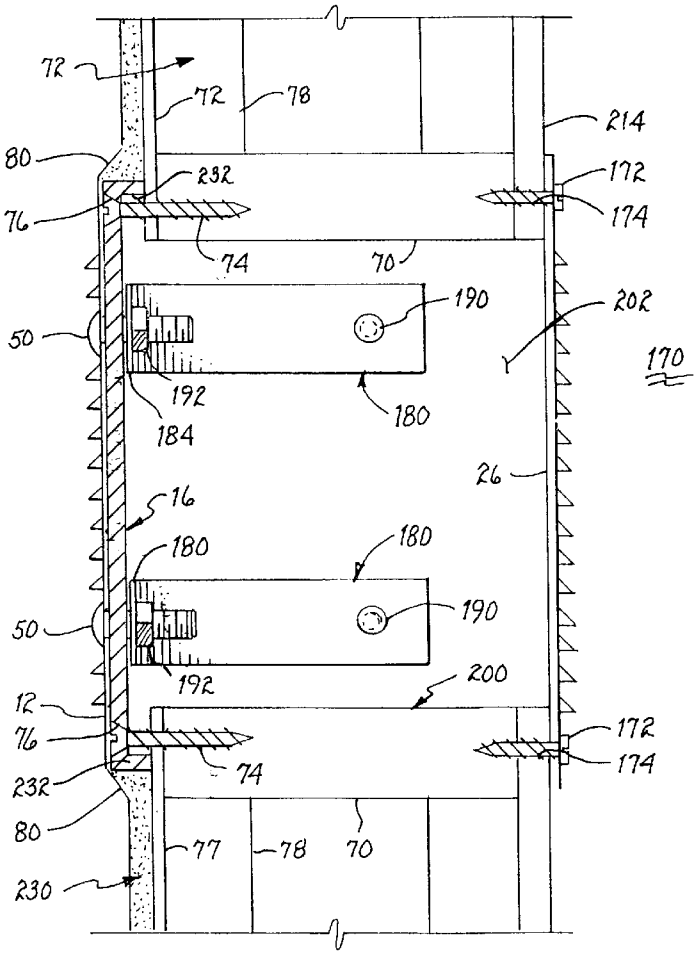
FIG. 9 is a cross-sectional view of the vent assembly adapted for use with an exterior stucco wall.

Referring to FIG. 9, a variant of security vent assembly 170 is illustrated and common elements will assigned common reference numerals. Security vent assembly 170 includes panel 26 mounted on side 214 to cover the interior opening of panel 200. The attachment of panel 26 may be by screws 172 penetrably engaging holes 174 in the panel and threadedly engaging studs 70 forming the perimeter of the passageway. Stucco is a common surface treatment of exterior walls on houses in the southwestern part of the United States. A coating of stucco upon the structural walls of a building is often used in the southwestern part of the United States. Such stucco covering has little structural strength and is used primarily for aesthetic purposes but it does have some thermal insulating capability. That is, it tends to reduce the heating of exterior walls due to solar radiation.

Security vent assembly 170 has been modified, as illustrated in FIG. 9 to accommodate the use of a coating 230 of stucco. Such a coating may be on the order of ½ inch to about 1 inch in thickness. To accommodate this additional thickness externally from exterior wall 72, security grate 16 includes a lip 232 extending essentially around the parameter of the security grate. This lip will serve in the manner of a dam against which stucco can be applied. As illustrated, the stucco will flow into the space about lip 232 of the security grate and bent flange 180 of apertured panel 12. Whatever stucco may come to lie upon flange 80 can be readily wiped off at the time of application of the stucco. Thereby, security vent assembly 170 illustrated in FIG. 9 accommodates application of stucco to the exterior wall after installation of security vent assembly.

In the event the security vent assembly is to be mounted after exterior wall 72 has received a coating of stucco, the stucco attendant pass the opening of passageway 200 is trimmed to size to accommodate insertion of lip 232 of the security grate. Flange 80 serves in the manner of a shield to cover any errors or irregularities in the edge of the stucco coating and hides them from view. Since installation costs of the security vent assembly are a function of time spent, the lack of a need to precisely trim the coating of stucco is a significant boon to the installer.

The vents with security grates discussed above were developed primarily for installation in existing exterior walls. Particularly with regard to existing stucco finished exterior walls, significant time, and therefore expense, is incurred by forming a visually and aesthetically acceptable opening in the stucco portion of the exterior wall. Even for new construction, the embodiment illustrated in FIG. 9 requires extra attention and detail work to develop an aesthetically acceptable junction between the protruding part of the vent and the adjacent stucco.

Figure 10:
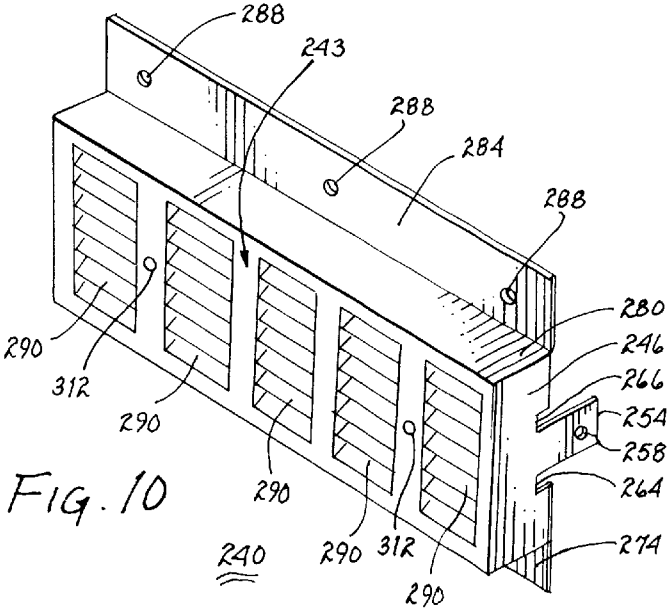
FIG. 10 is an isometric view of a unitary louver and security grate useable in new construction wherein a stucco finish is to be used on the exterior wall.

Referring to FIG. 10, there is shown a vent 240 particularly adapted for installation on new construction of an exterior wall, which wall is to receive a stucco finish. Vent 240 may be formed of a cut to shape sheet 242 of heavy gauge cold rolled steel approximately 1/16 inch in thickness. This material is not readily abused, bent or cut and therefore serves the function of the security grate discussed above. Sheet 242 includes a louvered panel 243, two opposed sidewalls 244, 246 bent along bend lines 248, 250, respectively. Sidewalls 242, 246 include tabs 252, 254 having one or more apertures 256, 258 formed therein. Slots 260, 262 may be formed on opposed sides of tab 252 to accommodate any bending of the tab relative to sidewall 244 to facilitate attachment to the sidewall of the passageway through the exterior wall in the event the sidewall of the passageway is not closely aligned with sidewall 244. Slots 264, 266 are formed on opposed sides of tab 254 for the same reason. An elongated section 270 is bent along bend line 272 to form the bottom edge of vent 240. The further elongated section 274 is bent along bend line 276 to form a mounting element for attaching the vent to the exterior wall by nails or screws commensurately engaging holes 278 in section 274. An elongated section 280 is bent along bend line 284 to form the top side of the vent. A further section 284 is bent along bend line 286 to serve as a mounting for attaching the vent to the exterior wall by nails or screws penetrably engaging holes 288. A plurality of louvers 290 (see FIG. 10) are formed in louvered panel 243 of sheet 242. Thereby, vent 240 accommodates airflow therethrough and as the vent is fabricated of relatively robust material, damage to or destruction of the vent is precluded except upon exertion of extraordinary efforts.

Figure 11:
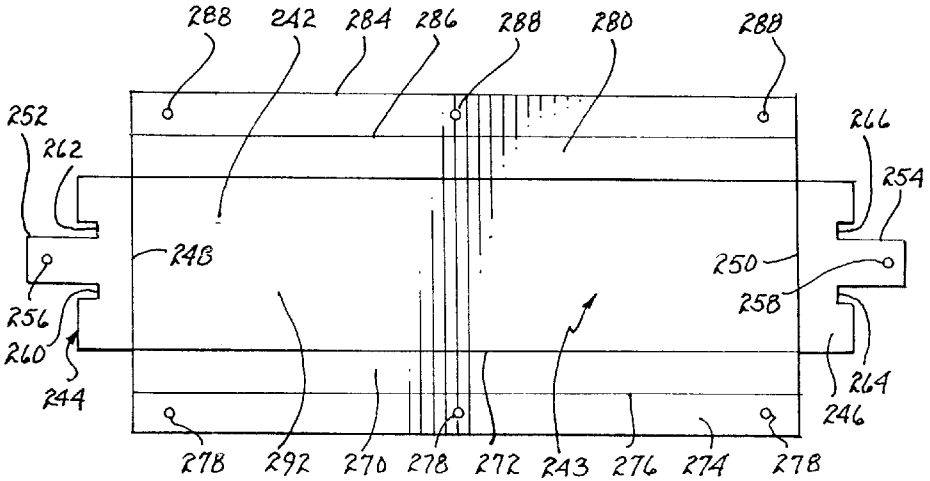
FIG. 11 illustrates the unitary louver and security grate prior to bending to shape.
Figure 12:
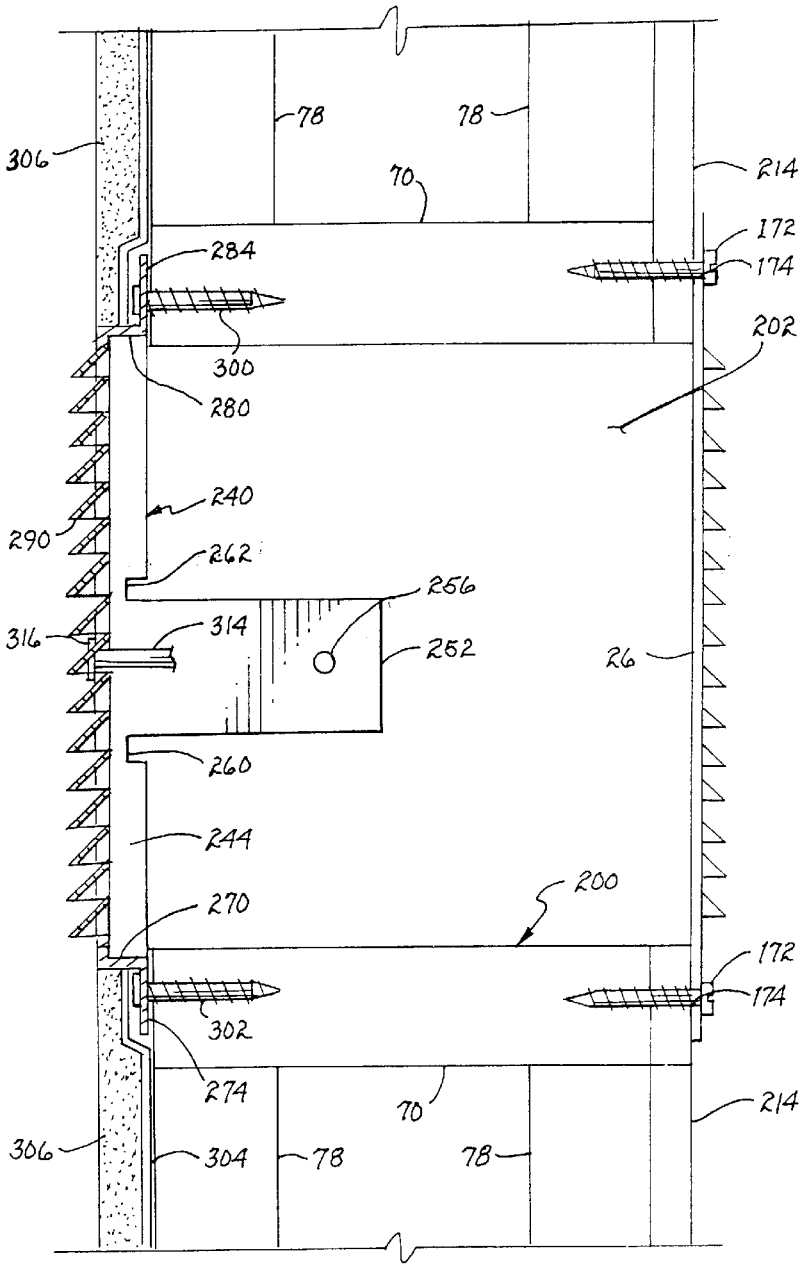
FIG. 12 is a representative cross-sectional side view of the unit shown in FIG. 10.

FIG. 12 illustrates a cross-sectional view of vent 240 mounted within a passageway 200 extending through an exterior wall. Section 284 is secured to stud 70 by a screw or nail 300 extending through one of apertures 288 in section 284. Similarly, a further screw or nail 302 extends through one of apertures 278 in section 274 into engagement with stud 70. After installation of vent 240, the procedure for adding stucco to the exterior wall may be performed. This procedure may take any one of several forms but usually involves laying down black paper 304, which paper would extend across sections 274, 284 and butt against sidewalls 244, 246 (see FIG. 11) of vent 240. Subsequently, chicken wire (not illustrated) is usually attached to provide purchase for the stucco. In certain installations, blue board may be lodged intermediate the black paper and the chicken wire primarily for insulation purposes. Thereafter, stucco 306 is applied to the exterior wall up to and in contact with sections 270, 284 and sidewalls 244, 246, which sections and sidewalls serve in the manner of a dam to render the application of stucco adjacent vent 240 a simple and easy procedure performable by craftsmen of conventional skill.

Figure 14:
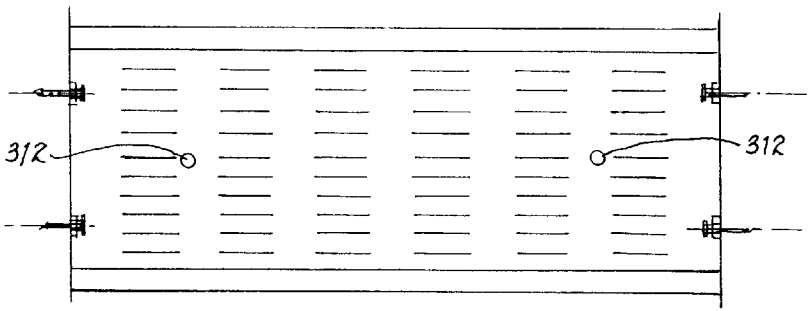
FIG. 14 is a representative rear view of the unit shown in FIG. 10.
Figure 13:
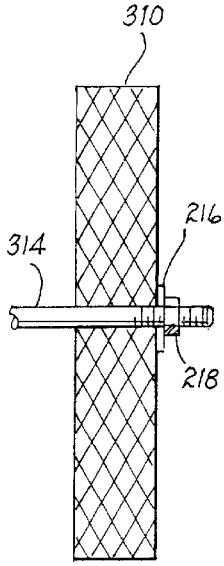
FIG. 13 illustrates an air filter useable in place of an interior louvered panel.

Either prior to or subsequent to the application of stucco, tab 252 and tab 254 (see FIG. 10) are attached to sidewall 202 by a screw or nail penetrably engaging apertures 256, 258, respectively. Thus, even though access to screws or nails 300, 302 is relatively easy, dislodgment thereof will not permit removal of vent 240 as the vent is robustly secured within passageway 200 by engagement of the tabs with the corresponding sidewalls. A louvered panel 260 may be attached to the interior opening of passageway 200 by nails or screws 172 penetrably engaging apertures 174 in the panel.

Where airborne dust and other particulate matter is to be prevented from entering through passageway 200, an air filter 310 shown in FIG. 13 may be attached to extend across the interior opening of passageway 200. To obtain this option, two or more apertures 312, as shown in FIG. 14, may be disposed within the louvered panel 243. Elongated threaded bolts or screws 314 extend through each of apertures 312. Each of the bolts include a head 316 to prevent pull through. The bolts extend through the interior opening of passageway 200 into penetrable engagement with air filter 310, as illustrated in FIG. 13. For ease of replacement of the air filter, a washer 216 and wingnut 218 may be used to draw the air filter tightly against the interior opening of the passageway.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A combustion air vent formed as a unitary structure from a sheet of cold rolled steel for use with an aperture at the exterior end of a passageway extending through an exterior wall of a building, said assembly comprising in combination:

a) a louvered panel;

b) top, bottom and side sections extending from said panel; and c) at least a tab extending from at least each of a pair of opposed ones of said sections, each of said tabs being adapted for mounting said tabs adjacent a sidewall of the passageway, each of said tabs being adapted to be secured to a corresponding wall of the passageway.

2. The assembly as set forth in claim 1 including a further section extending laterally outwardly from each of said top and bottom sections, each of said further sections being adapted for mounting said further sections in juxtaposed relationship to an element of the exterior wall to locate said louvered panel generally in the plane of an exterior opening of the passageway.

3. The assembly as set forth in claim 1 including a pair of slots extending from the edge of each of said side sections on opposed sides of the respective one of said tabs.

4. The assembly as set forth in claim 1 including at least a pair of bolts extending from said panel and an air filter mountable upon said pair of bolts.

5. The assembly as set forth in claim 4 including means for securing said air filter with said pair of bolts.

6. The assembly as set forth in claim 1 including a support extending from said louvered panel for supporting an air filter at an interior opening of the passageway.

7. A combustion air vent assembly for use with an aperture at the exterior end of a passageway extending through an exterior wall of a building, said assembly comprising in combination:

a) a louvered vent formed from a sheet of cold rolled steel;

b) said vent including a louvered panel;

c) a support extending from said louvered panel for supporting an air filter at an interior opening of the passageway, said support comprising a pair of bolts for penetrable engagement with said air filter;

d) said vent further including top, bottom and side sections extending from said panel; and e) at least a tab extending from each of opposed ones of said sections, each of said tabs being adapted for mounting said tabs adjacent a sidewall of the passageway.

8. The assembly as set forth in claim 7 including a wingnut in threaded engagement with each of said bolts for retaining said air filter in engagement with said bolts.

9. A method for venting and shielding a passageway extending through an exterior wall of a building, said method comprising the steps of:

a) attaching sections indirectly extending from a louvered panel to the exterior wall;

b) securing tabs extending from the louvered panel to corresponding sidewalls of the passageway; and c) displacing the louvered panel from the plane of the exterior wall juxtaposed with the first sections by a distance corresponding with second sections extending from the perimeter of the louvered panel, certain of the second sections supporting the corresponding first sections.

10. The method as set forth in claim 9 including the step of supporting an air filter extending across the passageway with bolts extending from the louvered panel.

11. The method as set forth in claim 9 including the step of bending the tabs to locate them adjacent a corresponding wall of the passageway.

12. A combustion air vent formed as a unitary structure of a common material and adapted for use with an aperture at the exterior end of a passageway extending through an exterior wall of a building, said air vent comprising in combination:

a) a front louvered panel;

b) top, bottom and a pair of side sections extending rearwardly from said panel; and c) at least a tab extending from at least each of a pair of opposed ones of said sections, each of said tabs being adapted for locating said tabs adjacent a sidewall of the passageway, each of said tabs being adapted to be secured to a corresponding wall of the passageway.

13. A combustion air vent as set forth in claim 12 wherein each of said tabs extends from one section of said pair of side sections.

14. A combustion air vent as set forth in claim 13 wherein each of said tabs includes a hole adapted for receiving an attachment means for securing said tabs to the respective sidewall of the passageway.

15. A combustion air vent as set forth in claim 12 including a further section extending from each of said top and bottom sections, each of said further sections being adapted for mounting said further sections in juxtaposed relationship to an element of the exterior wall to locate said louvered panel generally in the plane of the exterior end of the passageway.

* * * * *